US006868245B2

(12) United States Patent
Kinouchi

(10) Patent No.: US 6,868,245 B2
(45) Date of Patent: Mar. 15, 2005

(54) IMAGE FORMING APPARATUS HAVING A DEVELOPING-DEVICE ASSEMBLY COMPRISING DEVELOPING DEVICES

(75) Inventor: Naoto Kinouchi, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 25 days.

(21) Appl. No.: 10/391,584

(22) Filed: Mar. 20, 2003

(65) Prior Publication Data

US 2004/0184837 A1 Sep. 23, 2004

(51) Int. Cl.[7] ..... G03G 15/01
(52) U.S. Cl. ..... 399/227; 399/119
(58) Field of Search ..... 399/167, 53, 54, 399/55, 119, 222, 223, 226, 227

(56) References Cited

U.S. PATENT DOCUMENTS 5,646,721 A * 7/1997 Sugihara et al. ..... 399/176
5,655,190 A * 8/1997 Fuchiwaki ..... 399/227
6,671,480 B2 * 12/2003 Sugiyama ..... 399/227
6,684,041 B2 * 1/2004 Yokomori et al. ..... 399/167

FOREIGN PATENT DOCUMENTS

JP 5-066681 A 3/1993

OTHER PUBLICATIONS

U.S. patent application Ser. No. 10/254,784, Hachisuga, filed Sep. 26, 2002.

* cited by examiner

*Primary Examiner*—Hoang Ngo
(74) *Attorney, Agent, or Firm*—Foley & Lardner LLP

(57) ABSTRACT

An image forming apparatus includes a developing-device assembly, developing rollers, roller drive gears, a transmission gear, a roller drive motor, a take-in gear, and a generator. The developing-device assembly rotates and stops at a development position where a developing device faces a photosensitive member, thereby switching a developing device to the next one. At the development position, the developing roller provided on each of the developing devices supplies toner to the photosensitive member, and the roller drive gear attached to each developing roller meshes with the transmission gear. The roller drive motor transmits mechanical power to the transmission gear via a power transmission path. The take-in gear disposed coaxial with a rotational center of the developing-device assembly is meshed with the transmission gear. The generator is housed in the developing-device assembly and has a gear meshing with the take-in gear.

6 Claims, 4 Drawing Sheets

IMAGE FORMING APPARATUS HAVING A DEVELOPING-DEVICE ASSEMBLY COMPRISING DEVELOPING DEVICES

BACKGROUND OF THE INVENTION

1. Field of the Invention

The present invention relates generally to an image forming apparatus, and more particularly to an image forming apparatus that has a developing-device assembly, which is rotated to switch a plurality of developing devices, and forms an image based on electrophotography.

2. Description of the Related Art

An image forming apparatus that forms an image based on electrophotography includes a photosensitive member, a charging device, an exposing device, a developing device, a transfer device and a fixing device. An image forming apparatus for monochromatic printing has one developing device, whereas an image forming apparatus for multi-color printing includes a plurality of developing devices and may additionally include an intermediate transfer member.

The image forming apparatus for multi-color printing includes a developing-device assembly comprising a plurality of developing devices. The developing-device assembly is rotated like a cylinder of a revolver-pistol, whereby each developing device is switched. Each developing device includes a developing roller and a toner container. The toner container contains toner to be supplied to the developing roller.

In general, the multi-color printing image forming apparatus forms a multi-color image using three colors, yellow, magenta and cyan, or four colors, i.e. these colors plus black. If the toner of any one of these colors runs short, a multi-color image of a desired color tone cannot be obtained. It is thus necessary to understand the residual amount of toner in each developing device.

The residual toner amount in the toner container cannot be confirmed from the outside of the image forming apparatus, so a sensor for detecting the residual toner amount is provided for each toner container. In this case, since the toner container rotates along with the developing-device assembly, such a sensor cannot be attached by wiring. To cope with the problem, a transparent window is provided at a part of the toner container, and the residual toner amount is optically detected through the window.

In a case where toner adheres to the inside of the window, however, the residual toner amount may not correctly be detected. In order to enhance the reliability in detection of the residual toner amount, it is desired to directly provide the sensor on the toner container. However, since the developing-device assembly rotates, electric power cannot be supplied to the sensor.

Jpn. Pat. Appln. KOKAI Publication No. 5-66681 discloses an image forming apparatus that uses a method of supplying power to a rotary member. According to this publication, a generator is provided between a rotary photosensitive drum and a shaft that supports the photosensitive drum, and the generator supplies electric power to a heater built in the photosensitive drum. In this case, the generator generates power when the photosensitive drum rotates. In addition, a battery is provided to enable power supply even when the photosensitive drum is at rest.

In the case where this method is applied to supply electric power to devices mounted in the developing-device assembly, the following problem arises. Since the developing-device assembly rotates only intermittently, power is supplied only when the developing-device assembly rotates. Further, the number of revolutions of the developing-device assembly, compared to that of the photosensitive drum, is not sufficient for power generation or power accumulation.

BRIEF SUMMARY OF THE INVENTION

The present invention may provide an image forming apparatus capable of supplying electric power to devices carried in a rotary developing-device assembly.

According to an embodiment of the invention, an image forming apparatus includes a developing-device assembly, a developing roller, a roller drive gear, a transmission gear, a roller drive motor, a take-in gear, and a generator. The developing-device assembly switches a plurality of developing devices, which are carried on the assembly, by rotating to a development position where one of the developing devices face a photosensitive member. The developing roller is provided on each of the plurality of developing devices and supplies toner to the photosensitive member at the development position. The roller drive gear is attached to each of the developing rollers. The transmission gear meshes with the roller drive gear attached to the developing roller of one of the developing devices that is located at the development position. The roller drive motor transmits mechanical power to the transmission gear via a power transmission path. The take-in gear is disposed coaxial with a rotational center of the developing-device assembly and is meshed with the transmission gear. The generator is housed in the developing-device assembly and has a gear meshing with the take-in gear.

Objects and advantages of the invention will become apparent from the description which follows, or may be learned by practice of the invention.

BRIEF DESCRIPTION OF THE DRAWINGS

The accompanying drawings illustrate embodiments of the invention, and together with the general description given above and the detailed description given below, serve to explain the principles of the invention.

DETAILED DESCRIPTION OF THE INVENTION

An image forming apparatus according to an embodiment of the present invention will now be described with reference to FIGS. 1 to 6. The structure of the image forming apparatus is already described in senior U.S. patent application Ser. No. 10/254,784, so a description thereof is omitted here by reference, except for portions that require a particular description.

Figure 1:
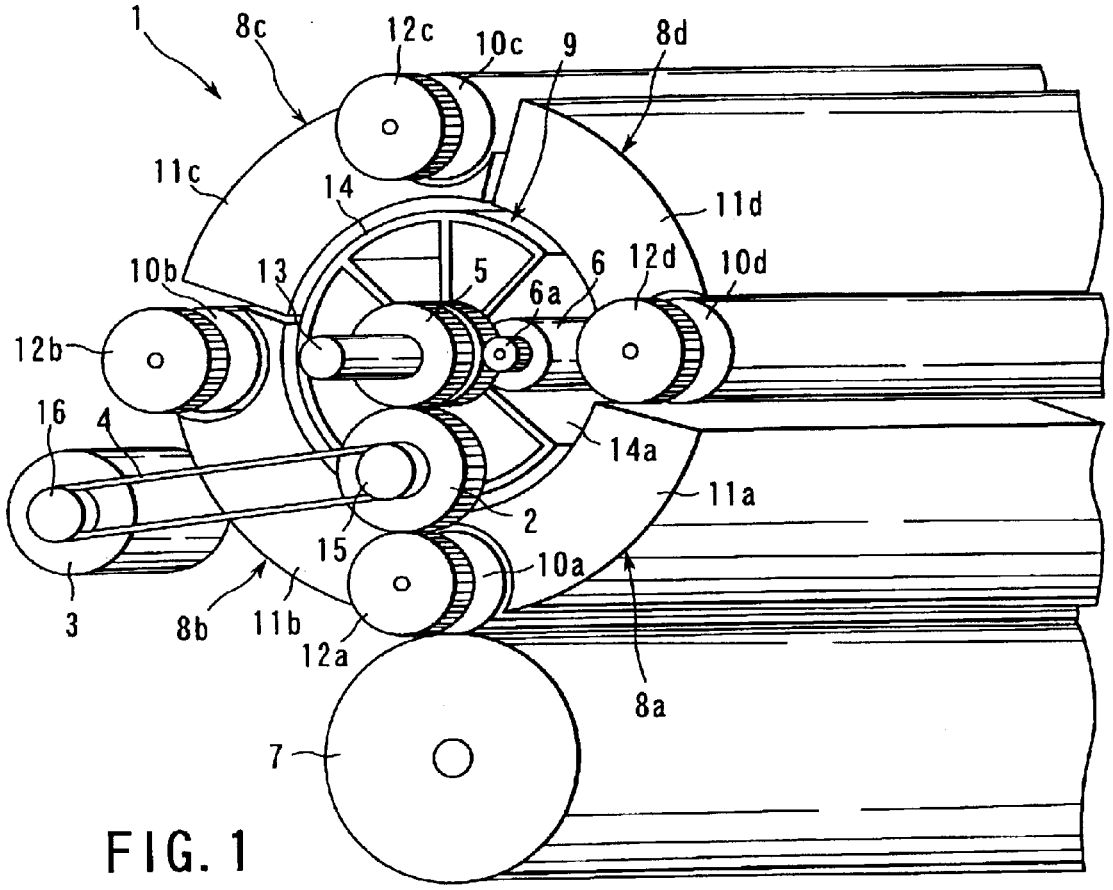
FIG. 1 is a perspective view showing one end portion of each of a developing-device assembly and a photosensitive drum in a development operation state in an image forming apparatus according to a first embodiment of the present invention.

The image forming apparatus, as shown in FIG. 1, includes a developing-device assembly 1, a transmission gear 2, a roller drive motor 3, a belt 4, a take-in gear 5, a generator 6, and a photosensitive drum 7.

The developing-device assembly 1 comprises a plurality of developing devices, for example, four developing devices 8*a*, 8*b*, 8*c* and 8*d* in the present embodiment, and a core unit 9 for supporting the developing devices 8*a*, 8*b*, 8*c* and 8*d*. The developing devices 8*a*, 8*b*, 8*c* and 8*d* have developing rollers 10*a*, 10*b*, 10*c* and 10*d* and toner containers 11*a*, 11*b*, 11*c* and 11*d*, respectively. The developing rollers 10*a*, 10*b*, 10*c* and 10*d* are provided at one end with roller drive gears 12*a*, 12*b*, 12*c* and 12*d*. The toner containers 10*a*, 11*b*, 11*c* and 11*d* contain toners of different colors associated with the developing devices 8*a*, 8*b*, 8*c* and 8*d*. In the present embodiment, they contain toners of four colors, yellow, magenta, cyan and black, respectively. The developing devices 8*a*, 8*b*, 8*c* and 8*d*are attached to an outer peripheral surface of the core unit 9.

Figure 2:
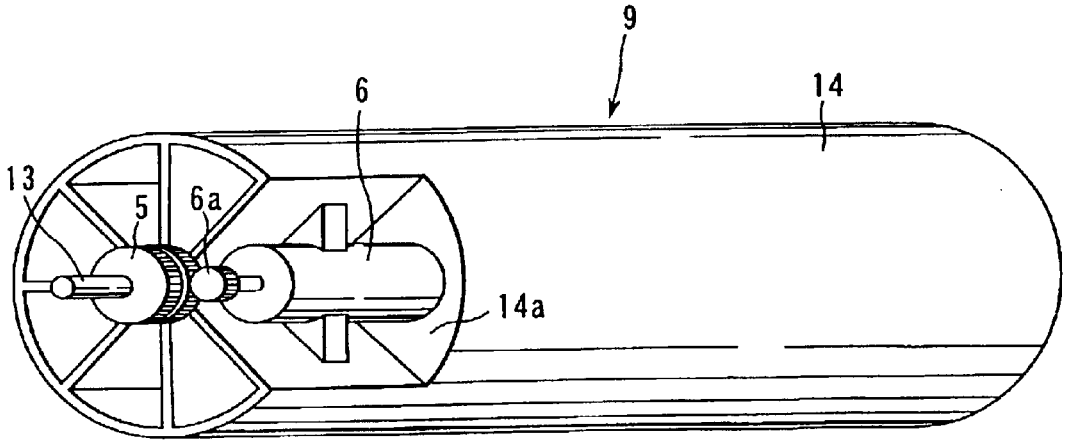
FIG. 2 is a perspective view depicting a core unit of the developing-device assembly shown in FIG. 1.

As is shown in FIG. 2, the core unit 9 comprises a shaft 13 and a cylindrical support member 14. The shaft 13 passes through a central part of the support member 14 and is supported in the inside of the image forming apparatus (not shown). The shaft 13 rotatably supports the developing-device assembly 1 within the image forming apparatus. Developing device-fixing members (not shown) are provided on an outer peripheral surface of the support member 14. The developing device-fixing members are configured to permit easy removal of the developing devices 8*a*, 8*b*, 8*c* and 8*d*.

The developing-device assembly 1 is rotated by a drive mechanism that is disposed on a side (not shown) opposed to the side shown in FIG. 1. The developing-device assembly 1 switches the developing devices 8*a*, 8*b*, 8*c* and 8*d* such that one of them is set in a development position facing the photosensitive drum 7 by rotating.

The transmission gear 2 is supported on the same inside of the image forming apparatus, where the roller drive gears 12*a*, 12*b*, 12*c* and 12*d* are disposed. As is shown in FIG. 1, the transmission gear 2 is engaged with the roller drive gear 12*a* of the developing device 8*a* set in the development operation state. A driven pulley 15 is attached to the transmission gear 2.

As is shown in FIG. 1, a driving pulley 16 is attached to a rotational shaft of the roller drive motor 3. The belt 4 is passed over the driving pulley 16 and driven pulley 15.

The take-in gear 5 is fitted on the shaft 13 on the same side where the roller drive gears 12*a*, 12*b*, 12*c* and 12*d* are disposed. The take-in gear 5 meshes with the transmission gear 2. The take-in gear 5 is freely rotatable relative to the shaft 13, regardless of the rotation of the developing-device assembly 1.

As is shown in FIG. 2, the generator 6 is disposed in a notch 14*a* formed in a part of the support member 14 on that side where the take-in gear 5 is attached. It should suffice if the notch 14*a* can receive the generator 6 inside the support member 14. The generator 6 is of a rotary type, and the rotational shaft of the generator 6 is furnished with a gear 6*a*. The gear 6*a* of generator 6 meshes with the take-in gear 5.

Figure 3:
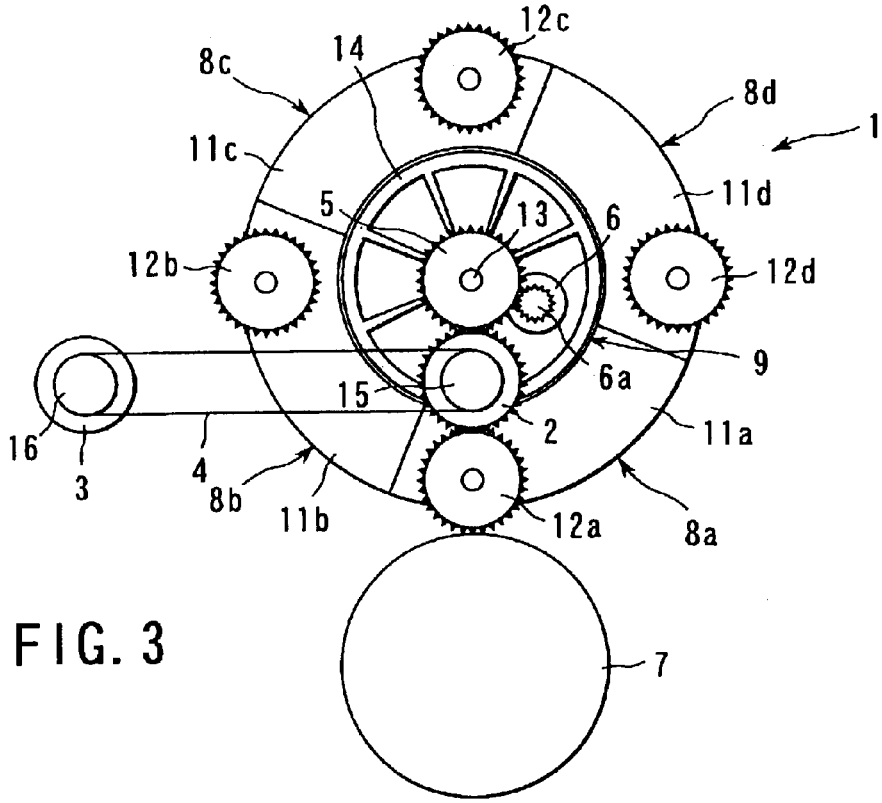
FIG. 3 is a side view schematically showing the developing-device assembly and photosensitive drum shown in FIG. 1.

When the developing-device assembly 1 is in the rotational position for the development operation state, as shown in FIG. 1, the cylindrical photo-sensitive drum 7 provided as the photosensitive member is positioned near, and in parallel with, the developing roller 10*a* of the developing device 8*a* that is set in the development operation position. As is shown in FIG. 3, when the developing-device assembly 1, transmission gear 2, photosensitive drum 7, etc., are viewed from their sides, the centers of the take-in gear 5, the transmission gear 2, the roller drive gear 12*a* of developing device 8*a* set in the development operation position and the photosensitive drum 7 are aligned in the radial direction of the take-in gear 5 that centers on the shaft 13.

The transmission gear 2 and the gear 6*a* of generator 6 are meshed with the take-in gear 5 such that the transmission gear 2 and the gear 6*a* are displaced from each other in the axial direction of the shaft 13. Therefore, even when the developing-device assembly 1 rotates, the gear 6*a* of generator 6 does not collide with the transmission gear 2. The take-in gear 5 has a portion meshing with the transmission gear 2 and a portion meshing with the gear 6*a* of generator 6, and these portions may be configured to have different diameters and different numbers of teeth so that mechanical powers corresponding to suitable numbers of revolutions may be transmitted to the transmission gear 2 and the gear 6*a* of generator 6, respectively.

In the present embodiment, mechanical power is transmitted from the roller drive motor 3 to the transmission gear 2 via a power transmission path that includes the driving pulley 16, driven pulley 15 and belt 4. Additionally, a tensioner may be provided at a position along the belt 4 so as to keep the tension of the belt 4 constant. The belt 4, driving pulley 16 and driven pulley 15 may be a toothed belt and toothed pulleys, or a chain and sprockets.

Figure 4:
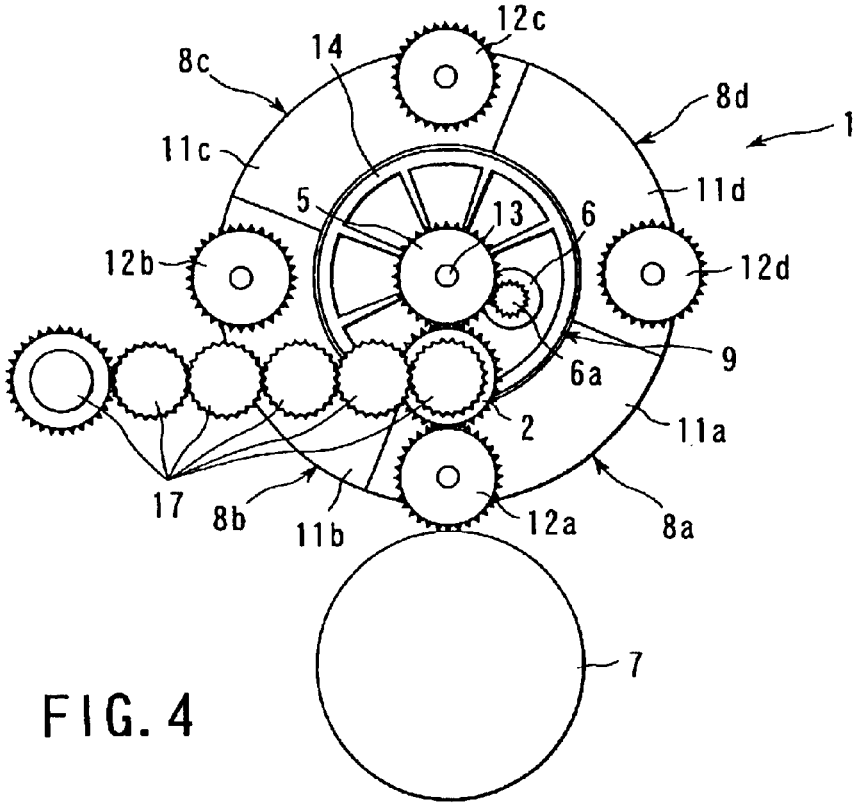
FIG. 4 is a side view schematically showing the developing-device assembly and photosensitive drum in a case where mechanical power is transmitted from a drive motor to an interlocking gear via a plurality of linkage gears.
Figure 5:
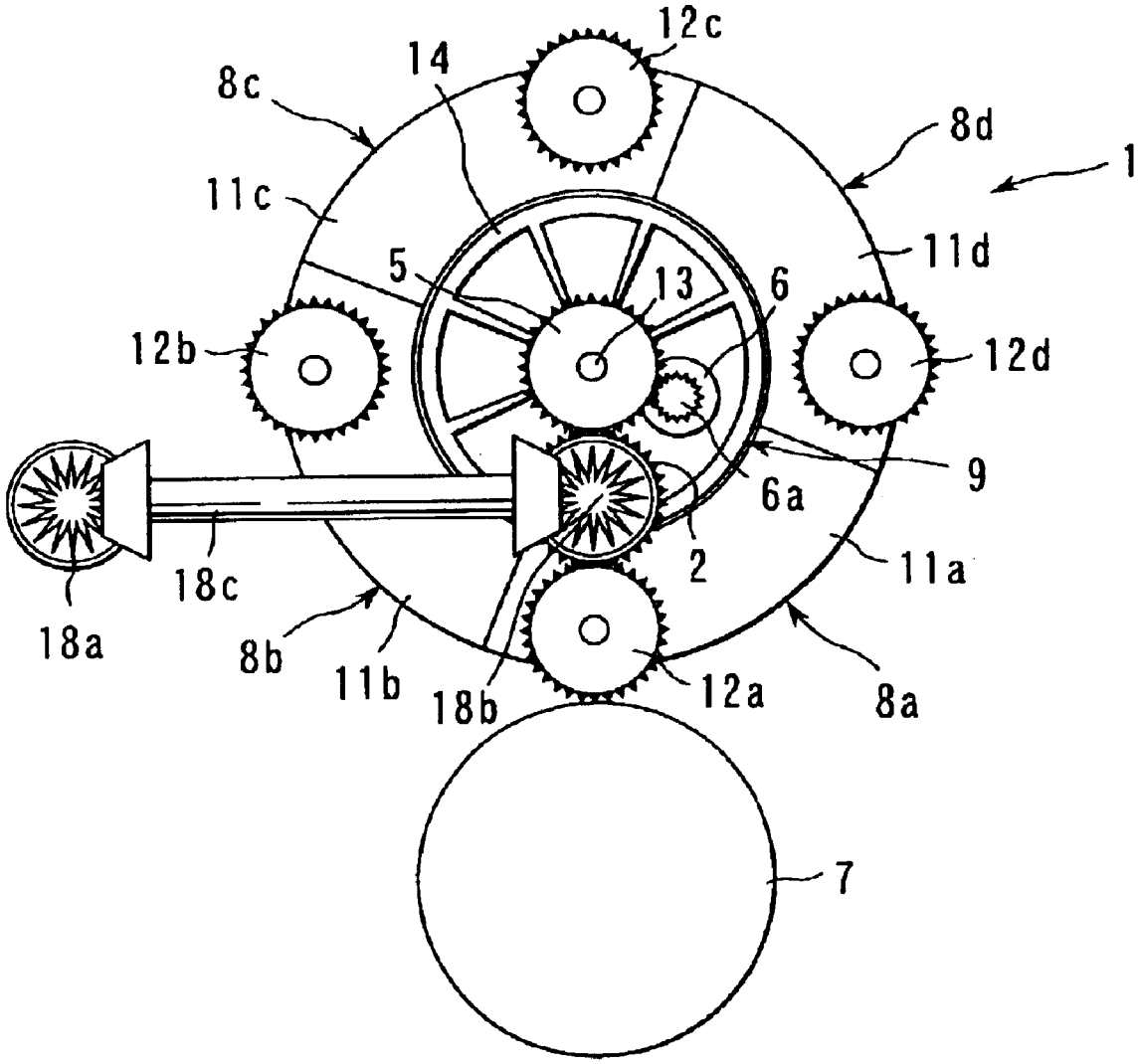
FIG. 5 is a side view schematically showing the developing-device assembly and photosensitive drum in a case where mechanical power is transmitted from the drive motor to the interlocking gears via a drive shaft with bevel gears.

As is shown in FIG. 4, mechanical power may be transmitted from the roller drive motor 3 to the transmission gear 2 via a power transmission path comprising a plurality of gears 17 combined as a gear train. Alternatively, as shown in FIG. 5, the power transmission path may comprise a driving bevel gear 18*a*provided on the roller drive motor 3, a driven bevel gear 18*b* provided on the transmission gear 2, and a drive shaft 18*c* having bevel gears at both ends thereof meshing with the bevel gears 18*a* and 18*b* to transmit mechanical power. Alternatively, the power transmission path may use such gears as a worm gear, a hypoid gear and a helical gear.

Figure 6:
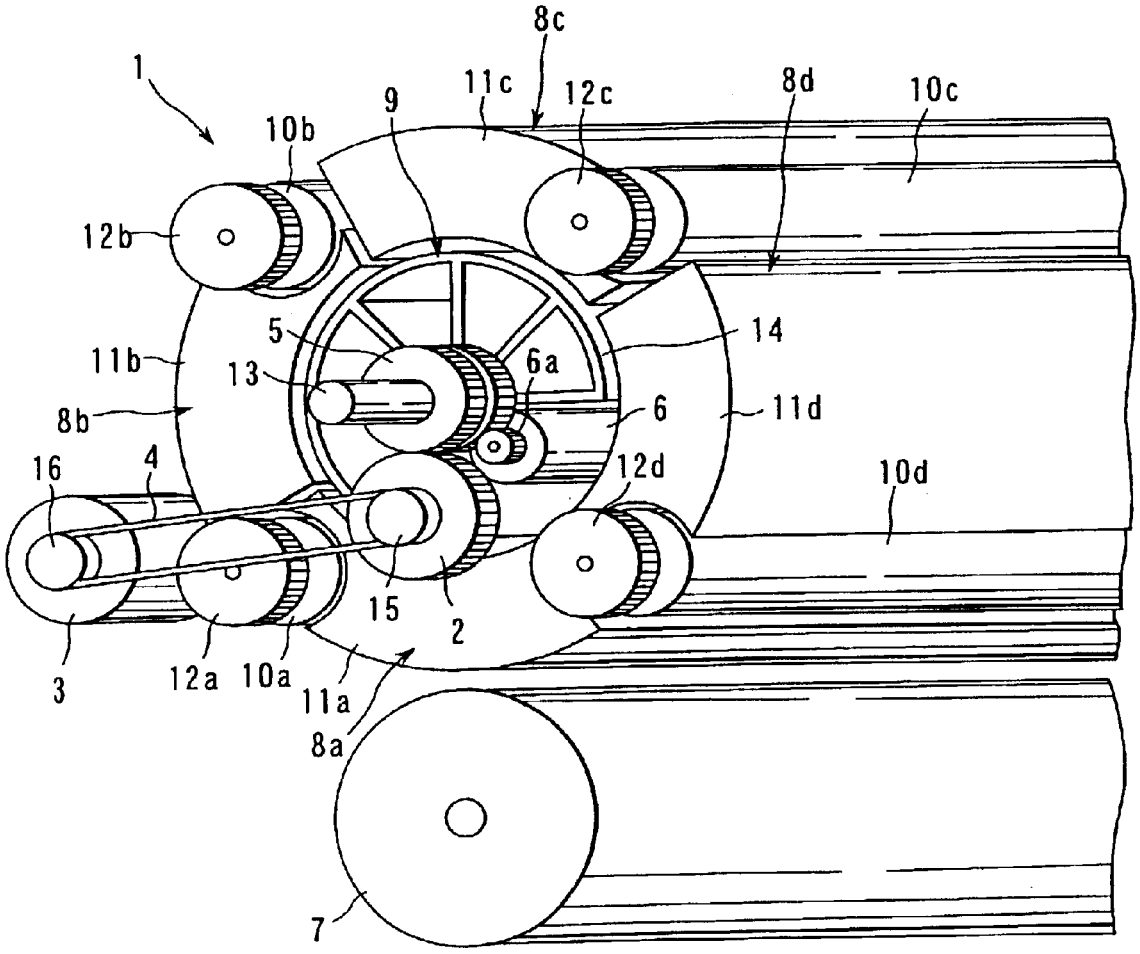
FIG. 6 is a perspective view showing one end portion of each of the developing-device assembly and photosensitive drum in a standby state of the developing-device assembly shown in FIG. 1.

In the image forming apparatus with the above-described structure, when the developing-device assembly 1 is in the standby state, the developing rollers 10*a*, 10*b*, 10*c* and 10*d* are at rest in such a position that none of them faces the photosensitive drum 7, as shown in FIG. 6. When a developing process is started, the developing-device assembly 1 rotates and brings one of the developing rollers of the developing devices 8*a*, 8*b*, 8*c* and 8*d*, for example, the developing roller 10*a* of the developing device 8*a* as shown in FIG. 1, to a position facing the photosensitive drum 7. With the rotation of the developing-device assembly 1, the developing device Ba is brought to the development position near the photosensitive drum 7, and the roller drive gear 12*a* is engaged with the transmission gear 2.

With the engagement between the roller drive gear 12*a* and transmission gear 2, mechanical power is transmitted from the roller drive motor 3 to the developing roller 10*a* via the power transmission path, which comprises the driving pulley 16, belt 4 and driven pulley 15, the transmission gear 2 and the roller drive gear 12*a*. The developing roller 10*a* is rotated by the transmitted mechanical power. If the developing roller 10*a* of the selected developing device 8*a* rotates, toner is supplied to the photosensitive drum 7 from the toner container 11*a* of developing device 8*a* via the developing roller 10*a*.

Upon completion of development by the developing device 8*a*, the developing-device assembly 1 rotates once again and brings the next developing device to the development position. Then, the roller drive gear attached to the developing roller of the developing device set at the development position meshes with the transmission gear 2.

In addition, since the transmission gear 2 also meshes with the take-in gear 5, the power transmitted from the roller drive motor 3 via the power transmission path is also transmitted from the transmission gear 2 to the take-in gear 5. Then, the mechanical power from the roller drive motor 3 is transmitted to the generator 6 via the take-in gear 5 and the gear 6*a* of generator 6. Thus, the generator 6 generates electric power. Thereby, electric power can be supplied to devices mounted in the developing-device assembly 1. The transmission gear 2 always meshes with the take-in gear 5 even when the developing-device assembly 1 rotates. Therefore, electric power can always be supplied to the devices mounted in the developing-device assembly 1.

Possible devices to be mounted in the developing-device assembly 1 are, for instance, residual toner amount sensors attached to the toner containers 11*a*, 11*b*, 11*c* and 11*d*, rotational speed sensors for the developing rollers 10*a*, 10*b*, 10*c* and 10*d*, and a rotational position sensor for the developing-device assembly 1.

Even when the developing-device assembly is at rest in the standby state, as shown in FIG. 6, the take-in gear 5 meshes with both the transmission gear 2 and the gear 6*a* of generator 6. Thus, the generator 6 can gain mechanical power from the roller drive motor 3 via the power transmission path, and can supply electric power to the devices mounted in the developing-device assembly 1. In other words; even in the case where there is no need to rotate the developing roller 10*a*, 10*b*, 10*c*, 10*d*, mechanical power may be supplied from the roller drive motor 3, whereby electric power can be supplied to the devices mounted in the developing-device assembly. Furthermore, the transmission of mechanical power to the generator 6 is effected by making use of the roller drive motor 3, transmission gear 2, driving pulley 16, driven pulley 15 and belt 4, which are provided to rotate the developing rollers 10*a*, 10*b*, 10*c* and 10*d*. Therefore, the structure of the image forming apparatus is not made complex.

In order to efficiently use electric power generated by the generator 6, the core unit 9 may be provided with an electric power accumulation device.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the inventive as defined by the appended claims and their equivalents thereof.

What is claimed is:

1. An image forming apparatus comprising:

a developing-device assembly having a plurality of developing devices and switching the plurality of developing devices by rotating one of the plurality of developing devices to a development position that faces a photosensitive member;

a developing roller provided on each of the plurality of developing devices and supplying toner to the photosensitive member at the development position;

a roller drive gear attached to each of the developing rollers;

a transmission gear meshing with the roller drive gear attached to the developing roller of one of the plurality of developing devices that is located at the development position;

a roller drive motor that transmits mechanical power to the transmission gear via a power transmission path;

a take-in gear disposed coaxial with a rotational center of the developing-device assembly and meshed with the transmission gear; and a generator housed in the developing-device assembly and having a gear meshing with the take-in gear.

2. The image forming apparatus according to claim 1, wherein the power transmission path includes:

a driving pulley attached to the roller drive motor;

a driven pulley rotatable along with the transmission gear; and a belt passed over the driving pulley and the driven pulley.

3. The image forming apparatus according to claim 1, wherein the power transmission path includes:

a motor gear attached to the roller drive motor;

an interlocking gear disposed in such a position as to be free from collision with the roller drive gear when the developing-device assembly rotates, and interlocking with the transmission gear; and at least one linkage gear that links the motor gear and the interlocking gear.

4. The image forming apparatus according to claim 1, wherein the power transmission path includes:

a driving bevel gear attached to the roller drive motor;

a driven bevel gear rotatable along with the transmission gear; and a drive shaft having bevel gears at both ends thereof and interlocking the driving bevel gear and the driven bevel gear.

5. The image forming apparatus according to claim 1, wherein the developing-device assembly includes:

a support member having an outer peripheral surface to which the plurality of developing devices are attached; and a shaft that passes through a central part of the support member and rotatably supports the support member.

6. The image forming apparatus according to claim 1, wherein the take-in gear meshes with the gear of the generator at a position that is displaced in a direction of a rotational axis of the take-in gear from a position where the take-in gear meshes with the transmission gear.

* * * * *